United States Patent [19]

Allmer

[11] 4,418,625

[45] Dec. 6, 1983

[54] BIDIRECTIONALLY OPERATIVE TIE EXCHANGING APPARATUS

[75] Inventor: Franz Allmer, Sophia, N.C.

[73] Assignee: Canron Corporation, West Columbia, S.C.

[21] Appl. No.: 367,936

[22] Filed: Apr. 13, 1982

Related U.S. Application Data

[63] Continuation-in-part of Ser. No. 274,768, Jun. 18, 1981.

[51] Int. Cl.[3] ..... B61D 15/00; B01B 29/06; B01B 29/10

[52] U.S. Cl. ..... 104/9; 37/104

[58] Field of Search ..... 37/104; 104/9, 15

[56] References Cited

U.S. PATENT DOCUMENTS

| | | | |
|---|---|---|---|
| 1,613,037 | 1/1927 | Kniffen | 104/9 |
| 3,537,400 | 11/1970 | Taylor | 104/9 |
| 3,780,664 | 12/1973 | Holley et al. | 104/9 |
| 3,948,185 | 4/1976 | Settle et al. | 104/9 |
| 3,964,397 | 6/1976 | Dieringer et al. | 104/9 |
| 4,133,266 | 1/1979 | Taylor | 104/9 |
| 4,348,959 | 9/1982 | Bommart | 104/15 |

FOREIGN PATENT DOCUMENTS

| | | | |
|---|---|---|---|
| 871566 | 5/1971 | Canada | 254/111 |
| 202967 | 1/1924 | United Kingdom | 104/9 |

*Primary Examiner*—Robert B. Reeves
*Assistant Examiner*—Howard Beltran
*Attorney, Agent, or Firm*—Lane, Aitken & Kananen

[57] ABSTRACT

A compact bidirectionally operative tie exchanging apparatus includes an extensible telescoping beam assembly carried in a support cradle mounted on the underside of a railway maintenance car. In a first embodiment, the beam assembly includes an inner and an outer beam telescopically received within one another with hydraulically actuated tie clamping arms mounted on the opposite, remote ends of the beams assembly. A push/pull hydraulic cylinder has its ram and its cylinder connected, respectively, to the inner and outer beams. Hydraulically actuated locking pins mounted on the support cradle are selectively actuatable to lock either the inner beam or the outer beam to its respective support cradle. When the inner beam is locked to its support cradle and the push/pull hydraulic cylinder actuated, the unlocked outer beam can be extended and retracted to remove and replace railway ties from one side of the rail bed and, when the outer beam is locked to its support cradle and the push/pull hydraulic cylinder actuated, the unlocked inner beam can be extended and retracted from the other side of the rail bed. In another embodiment, the tie exchanging apparatus is mounted on a turret to permit controlled rotation about the vertical axis. The rail tie exchanger is advantageously compact, simple to operate, and can be used with equal facility for removing rail ties from one side of a rail bed or the other.

21 Claims, 16 Drawing Figures

202
246
244
236
230
234
206
238b
238a
238
240d
238d
238c
230'
240
240e
238d'
238c'
202'
244'
236
234'
206'
238b'
238a'
238'

240b
240d
240e

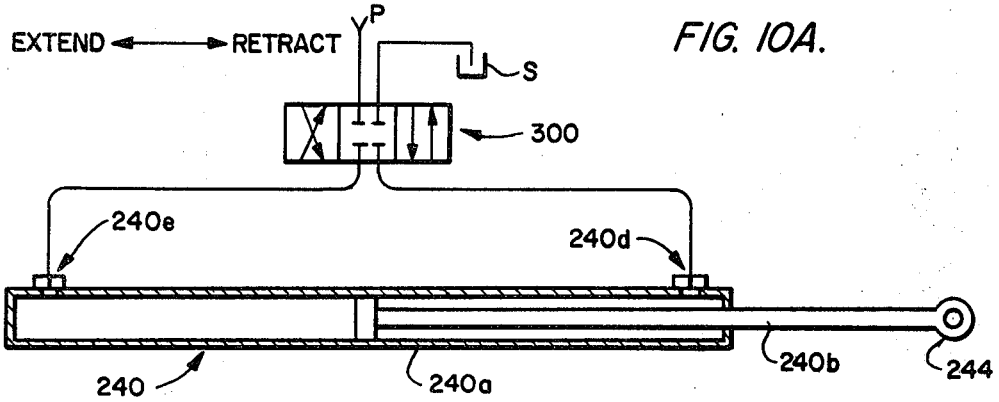
FIG. 10A.
FIG. 10B.
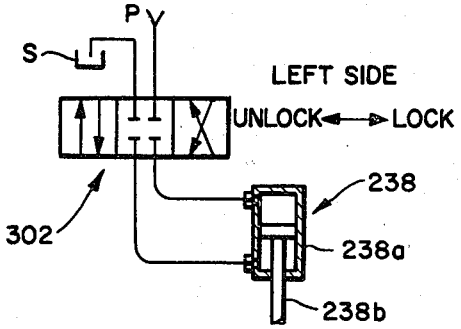
FIG. 10C.
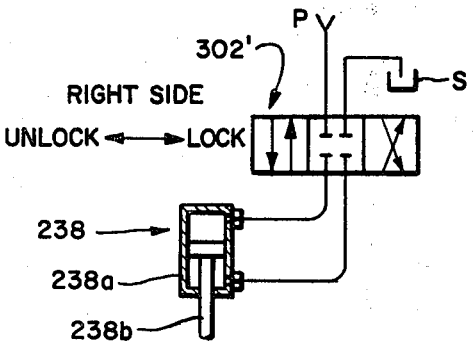
FIG. 10D.
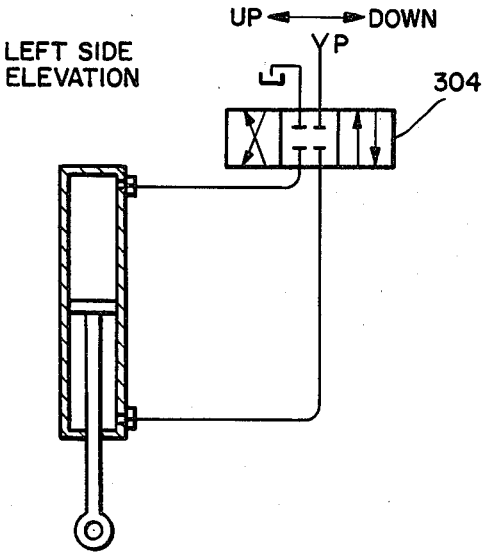
FIG. 10E.
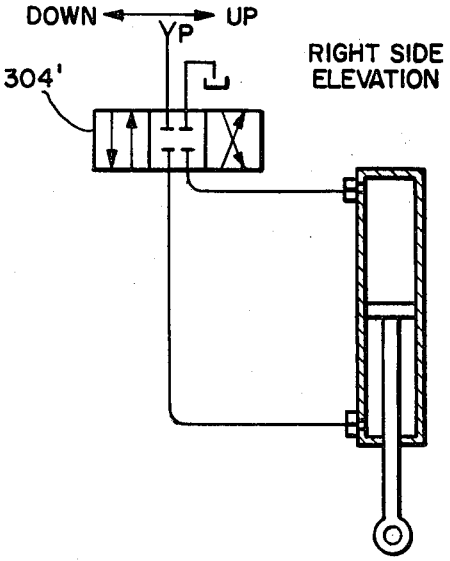

BIDIRECTIONALLY OPERATIVE TIE EXCHANGING APPARATUS

CROSS REFERENCE TO RELATED APPLICATION

The invention disclosed herein is related to that disclosed in U.S. patent application Ser. No. 274,768 as a continuation-in-part filed June 18, 1981 by Franz Allmer and commonly assigned herewith.

BACKGROUND OF THE INVENTION

The present invention relates to a rail bed maintenance apparatus and, more specifically, to an apparatus for removing and replacing railway cross ties from a rail bed.

Various machines are known for removing and replacing railway cross ties from a rail bed for maintenance purposes. These machines have included apparatus for sawing or otherwise severing the tie in its mid-section and for withdrawing the so-severed halves, for connecting flexible cables to the tie to pull it from the track, and more sophisticated machines that include hydraulically operated booms for engaging an end of the tie to apply a thrust force that pushes the tie laterally outward from the one side of the rail bed, and various pulling machines for manually gripping the end of the tie and pulling the so-gripped tie from the rail bed. In general, the known machines provide acceptable levels of performance although these machines possess certain disadvantages or drawbacks that are related to their structural arrangements or their method of operation. For those machines that sever the tie prior to its withdrawal, it is necessary to manipulate a severing device, such as a saw blade or opposed cutting blades, to effect the severing operation. In the course of the operation of these severing machines, the cutting blades must be re-sharpened or replaced periodically which, of course, adds to the expense of the tie removal and replacement operation. Those machines which push or pull the tie from the rail bed are generally quite large and some are also restricted to removing and replacing rail ties from one side of the rail bed or the other. In those cases where it is desired to pull or push a tie from either side of the rail bed, it is often necessary in some machines to reverse the orientation of all or a major portion of the machine components.

In general, known tie exchanging machines are most effective for removing and replacing ties that are optimally positioned, that is, ties that are generally perpendicular to the direction of the rails and generally parallel to the rail bed. There are situations, however, in which the ties may not be optimally positioned including those ties, for example, that support the rails in a switch arrangement where some of the ties may be at an angle relative the supported rail, that angle depending upon the angle of the turnout. In this situation, the efficiency of some known machine may be impaired since they may not be able to apply a force along the axis of the tie.

SUMMARY OF THE INVENTION

In view of the above, it is a primary object of the present invention, among others, to provide a cross tie removing machine that is compact in size and which is simple to operate.

It is another object of the present invention to provide a cross tie exchanging apparatus that can remove railway cross ties with equal facility from either side of the rail bed without the need for reversing the orientation of major apparatus components.

It is also an object of the present invention to provide a cross tie removal and replacing machine that can insert cross ties into a rail bed from either side of a railway vehicle.

It is still another object of the present invention to provide a cross tie removal and replacing machine that can remove or replace ties from either side of the rail bed including ties that lie at an angle relative the direction of the rails and/or the plane of the rail bed.

In accordance with these object and others, the present invention provides a cross tie removal and replacement machine for removing and inserting cross ties from either side of a rail bed. In one embodiment, the machine includes a support cradle or frame that is connected to the chassis of a suitable railway vehicle and which supports a telescoping beam assembly in a position directly above and parallel to the tie to be removed. The telescoping beam assembly includes an inner beam telescopically received within an outer beam with hydraulically actuated tie clamping assemblies mounted on the outward ends of the beams. A push-pull fluid cylinder is connected to the inner and outer beams so that the fluid cylinder, when extended, causes the inner and outer beam to telescope outwardly relative to one another and, when retracted, causes the beams to retract to a nested position. Fluid actuated lock pins are mounted on the support cradle and are selectively actuated to lock the inner beam to its support cradle or, in the alternative, lock the outer beam to its support cradle. When the inner beam lock pin is actuated to lock the inner beam to its support cradle and the fluid cylinder is actuated, the outer beam is operative to telescopically extend and retract laterally outward from one side of the rail bed; conversely, when the outer beam lock pin is actuated to lock the outer beam to its support cradle and the fluid cylinder similarly actuated, the inner beam is operative to telescopically extend and retract laterally outward from the other side of the rail vehicle. Accordingly, by selective actuation of the lock pins and actuation of the fluid cylinder, is is possible to effect tie removal from either side of the rail vehicle as contrasted to prior designs which remove the ties from a preferred side or in which major machine components must be reoriented to effect removal from the opposite side of the vehicle. The support cradle is connected to the rail vehicle by individually controlled fluid actuators which permit control of the elevation and angle of inclination of the beam assembly relative the tie to be removed so that forces can be applied along the axis of ties that lie at an inclined angle relative to the rail bed. In another embodiment of the present invention, the beam assembly is mounted on a turret that permits rotation about the vertical axis so that the beam assembly can be aligned with ties that lie at an angle relative to the direction of the rails, for example, when removing and replacing ties on the turn-out side of a switch. The cross tie exchange apparatus in accordance with the present invention is compact, very sturdy, and can be fabricated at lower cost compared to prior designs.

BRIEF DESCRIPTION OF THE DRAWINGS

The above description, as well as the objects, features, and advantages of the present invention will be more fully appreciated by reference to the following detailed description of presently preferred but nonetheless illustrative embodiments in accordance with the present invention when taken in conjunction with the accompanying drawings wherein:

FIG. 10A illustrates a hydraulic fluid circuit suitable for effecting operation of the hydraulic cylinder that extends and retracts the inner and outer beams;

FIGS. 10B and 10C illustrate hydraulic circuits for effecting bidirectional operation of the lock pins for selectively locking the inner or outer beams to their respective support cradles;

FIGS. 10D and 10E illustrate hydraulic circuits for hydraulically raising and lowering the cross tie exchanger relative to the tie to be replaced;

DESCRIPTION OF THE PREFERRED EMBODIMENT

Figure 1:
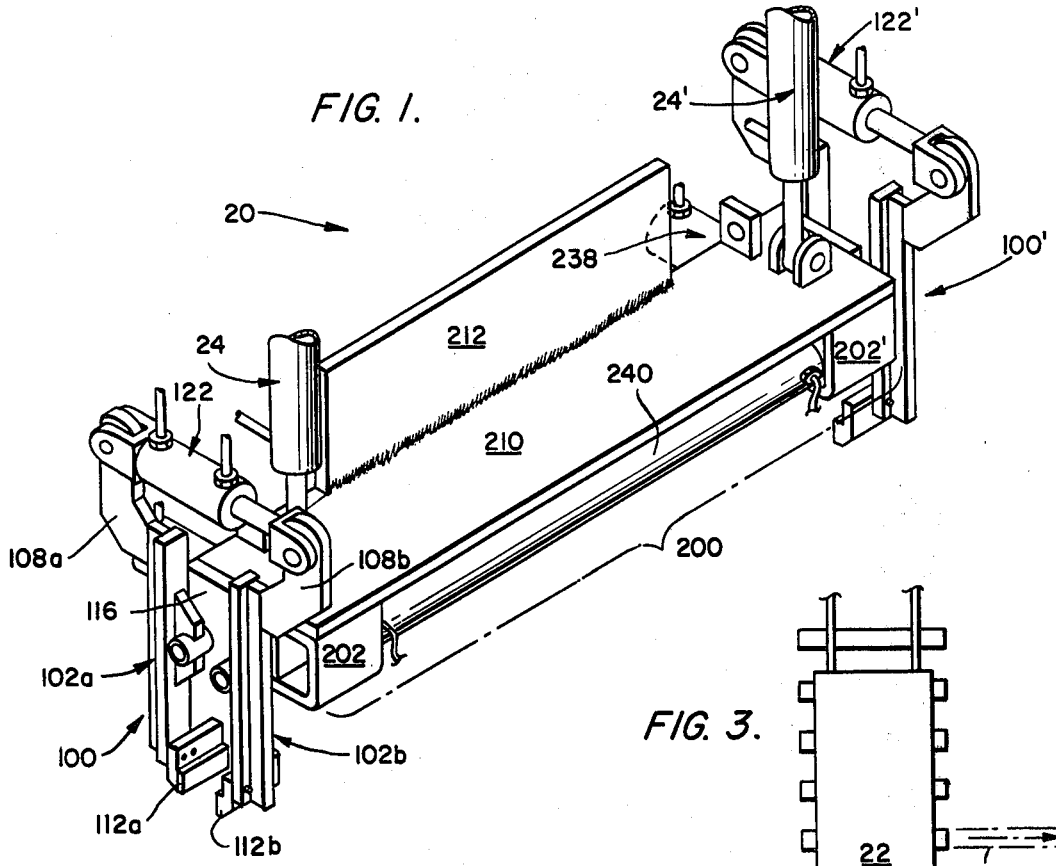
FIG. 1 is a perspective view of the cross tie exchanging apparatus in accordance with the present invention showing tie clamping assemblies at opposite ends of a telescoping beam assembly.
Figure 3:
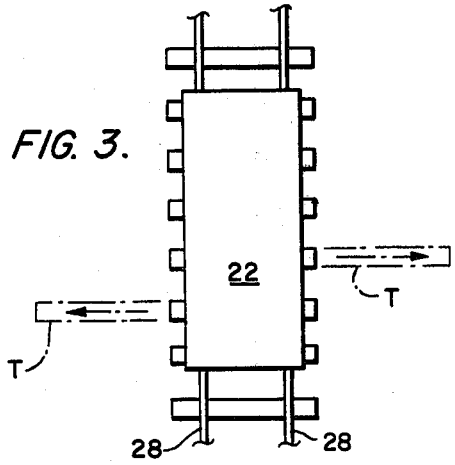
FIG. 3 is a plan view of a segment of a rail bed including tracks and associated cross ties with a railway vehicle located on the tracks.
Figure 2:
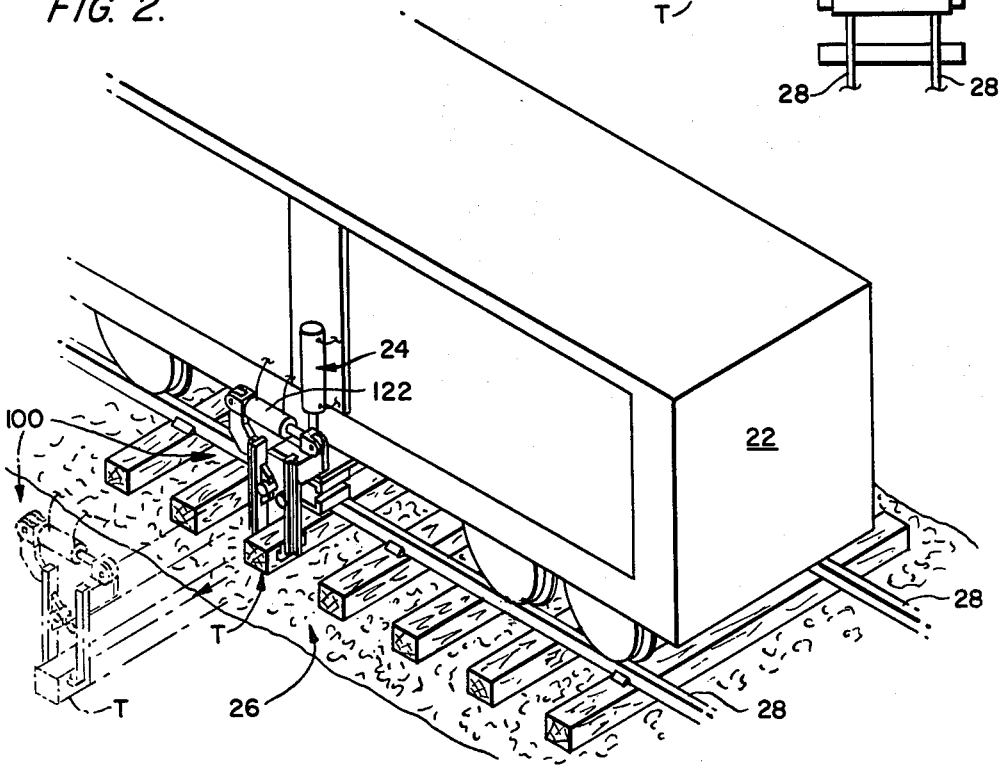
FIG. 2 is a perspective view of one side of a rail vehicle equipped with a cross tie exchanging apparatus of the type shown in FIG. 1 illustrating a portion (phantom line illustration) of the apparatus extending laterally outward from one side of the vehicle.
Figures 4, 5, 6:
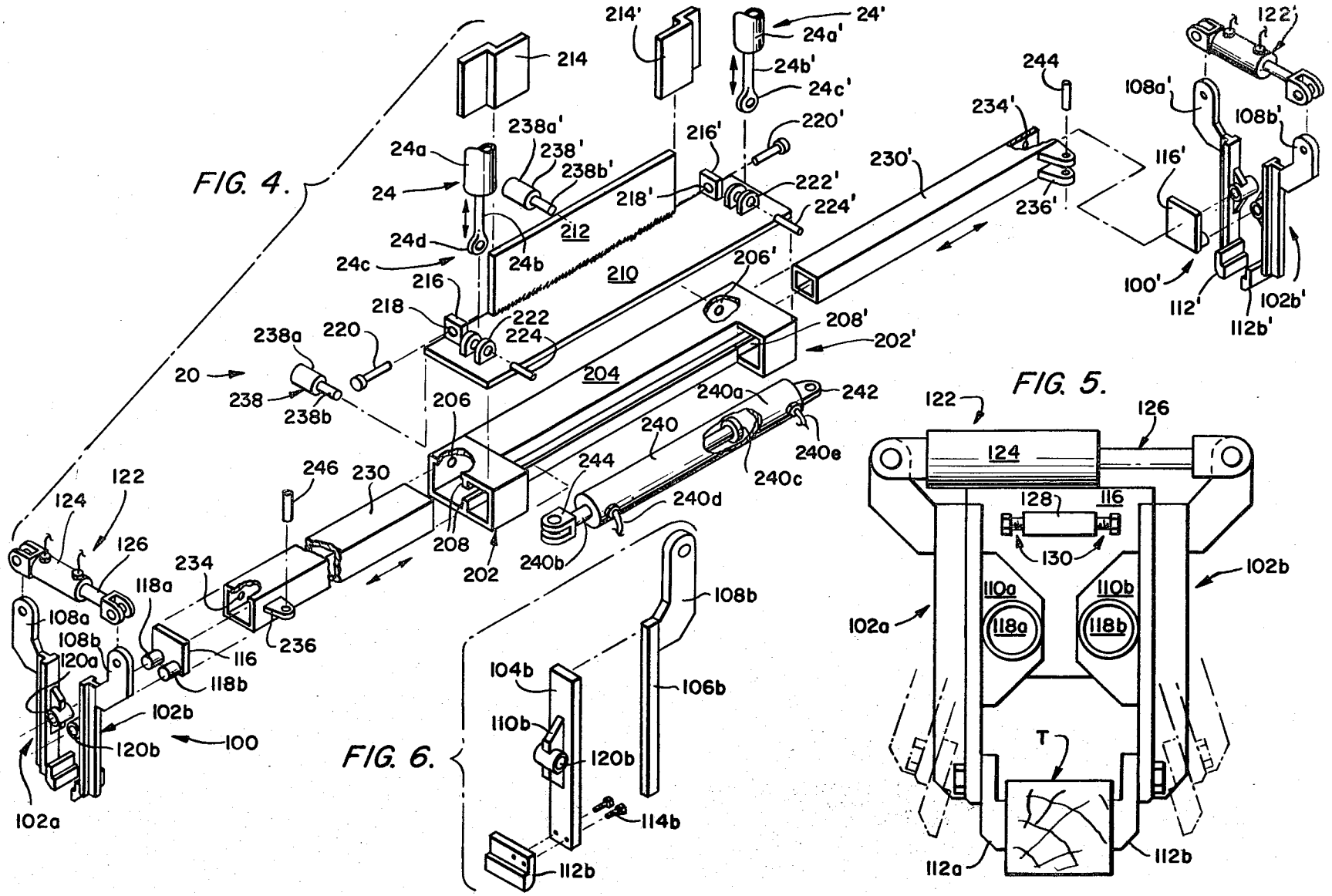
FIG. 4 is an exploded perspective view of the cross tie exchanging apparatus shown in FIG. 1.
FIG. 5 is an end elevational view of a tie clamp assembly showing the assembly in a clamped position (solid line illustration) and an unclamped or retracted position (broken line illustration)
FIG. 6 is an exploded perspective view of one of the clamping arms of the clamping assembly shown in FIG. 5.

A first embodiment of a cross tie exchanging apparatus in accordance with the present invention is shown in an assembled perspective in FIG. 1 and exploded perspective in FIG. 4 and referred to generally herein by the reference character 20. The cross tie exchanger 20 includes tie clamping assemblies 100 and 100' attached to opposite ends of a telescoping beam assembly 200 that extends between the clamping assemblies. As shown in FIG. 2, the cross tie exchanger 20 is attached to the underside of the carriage or chassis of a railway car 22 by vertically aligned hydraulic cylinders 24 and 24' located on each side of the car as explained more fully below. The cross tie exchanger 20 can be raised or lowered relative to the rail bed 26 by appropriate control of the cylinders 24 and 24' to control the attitude of the cross tie exchanger over a tie T to be removed. Once the cross tie exchanger 20 is positioned over a selected tie T by movement of the rail car 22 along the track 28, the exchanger is raised or lowered to a preferred attitude to permit the tie clamping assembly 100 to clamp the end of the tie T. Thereafter, the beam assembly 200 is caused to operate, as explained more fully below, to pull the tie T laterally outward from the rail bed 26 as shown in phantom line illustration in FIG. 2. The cross tie exchanger 20 may also be used to insert the tie T into the rail bed 26 by clamping the end of a replacement tie in the clamping assembly 100 and then retracting the beam assembly 200 to insert the tie into position. As shown in FIG. 3, the cross tie exchanger 20 is effective for pulling ties T from the rail bed 26 in either lateral direction and is equally effective for inserting new ties T into the rail bed 26 from either direction.

The clamp assemblies 100 and 100' are identically constructed; a description of the clamp assembly 100 being sufficient to describe both the clamp assembly 100 as well as the clamp assembly 100'. As shown in FIGS. 1, 4, 5, and 6, the clamp assembly 100 includes opposed clamping arms **102*a* and 102*b*, each fabricated as a structural steel weldment, with the clamping arm 1026 including as shown in the exploded perspective view of FIG. 6, a clamping bar 104*b*, a reinforcing spine 106*b* that is welded to the back face of the clamping bar 104*b*, an outwardly and upwardly extending connecting lug 108*b* welded to the upper portion of the reinforcing spine, an apertured lug 110*b* welded to the front face of the clamping bar, and a detachable clamping plate 112*b* secured to the lower end of the clamping bar 104*b* by threaded fasteners 114*b* extending through suitable clearance bores in the lower end of the clamping bar 104*b* into threaded bores (not shown) in the clamping plate 112*b*. It can be appreciated from FIG. 4 that a similar clamping bar, reinforcing spine, connecting lug, apertured lug, detachable clamping plate and threaded fasteners are associated with the clamping arm 102*a*. The clamping arms 102*a* and 102*b* are mounted symmetrically relative to the vertical on a mounting plate 116 with hinge pins 118*a* and 118*b* passing through appropriately sized bores 120*a* and 120*b*, respectively, formed in the lugs 110*a* and 110*b*. A bidirectionally operative hydraulic cylinder 122 that includes a cylinder portion 124 and a ram 126 is connected between the lugs 108*a* and 108*b* (by conventional clevis-and-pin connections) of the two clamping arms 102*a* and 102*b*. As shown in FIG. 5, the hydraulic cylinder 122 is operative (solid line illustration) to cause the clamping arms 102*a* and 102*b* to pivot towards one another to grip a tie T between their respective clamping plates 112*a* and 112*b* and, conversely, operative (phantom line illustration) to cause the clamping arms 102*a* and 102*b* to pivot to release the so-gripped tie T. A stop limit unit 128 (FIG. 5) is secured to the mounting plate 116 between the clamping arms 102*a* and 102*b* to establish the maximum open position of the clamping arms. The stop limit unit 128 includes adjustable threaded fasteners 130 having head portions that are positioned to contact and halt movement of the clamping arms 102*a* and 102*b*** to establish the maximum open position.

The beam assembly 200, as shown in FIGS. 1 and 4, includes first and second cradles 202 and 202' fabricated as hollow, rectangular box weldments and interconnected by a hollow, box-like support tube 204. Each cradle 202 and 202' includes a lock pin entry opening 206 and 206', respectively, and beam guide plates 208 and 208'. The cradles 202 and 202' and the support tube 204 are connected, as by welding, to the underside of a horizontally disposed support plate 210 that has a guide plate 212 secured thereto in a direction generally parallel to the axis of the support plate 210 and generally perpendicular thereto. The guide plate 212 is received within two guide rails 214 and 214' that are secured to appropriate structural portions (not shown) of the rail car 22 under chassis. The guide rails 214 and 214' restrain the guide plate 212 for guided motion in the vertical direction although sufficient side-to-side clearance is provided between the side edges of the guide plate 212 and the guide rails 214 and 214' to permit adjustment of the attitude or angular alignment of the beam assembly 200 by appropriate control of the hydraulic cylinders 24 and 24'. Two lock-up lugs 216 and 216' are secured to the top of the support plate 210 and include holes 218 and 218', respectively, for cooperation with lock-up pins 220 and 220' and mating apertured lugs (not shown) on the rail car 22 to secure the cross tie exchanger 20 to the rail car in a stowed position. The hydraulic cylinders 24 and 24' that are used to change the elevation and relative attitude of the cross tie exchanger 20 each include a cylinder **24*a* and downwardly extending ram 24*b*. The lower end of the ram 24*b* includes a lug 24*c* that connects to a pair of spaced apart aperture tabs 222 through a cooperating pin 224. The hydraulic cylinders 24 and 24' are operative, as described more fully below, to elevate and lower the cross tie exchanger 20 relative to the rail bed 26**.

The cradles 202 and 202', the support tube 204, and the support plate 210 define a frame for supporting an outer beam 230 and an inner beam 230'. The outer and inner beams 230 and 230' are formed as elongated hollow box members and may be fabricated as weldments. The outer beam 230 includes a lock pin hole 234 and an apertured tab 236. In a similar manner, the inner beam 230' includes a lock pin 234' and a set of apertured lugs 236'. The clamping assemblies 100 and 100', as described above, are secured to the remote ends of their respective beams 230 and 230' by, for example, bolting, welding, or otherwise securing the locking plates 116 and 116' of the respective clamp assemblies 100 and 100' to the distal ends of the beams.

The inner beams 230' has a smaller height and width relative to the outer beam 230 so that the inner beam 230' is telescopically received within the outer beam 230. The outside surface dimensions of the inner beam 230' and the inner surface dimensions of the outer beam 230 are selected so that a clearance fit exists therebetween to permit relative sliding movement. The outer beam 230 and the inner beam 230' are both received with the cradles 202 and 202' and the support tube 204. While not specifically shown in the figures, load bearing pads or plates fabricated from a suitable bearing material such as brass, bronze, or the like, are positioned between the various moving parts to facilitate guided relative sliding therebetween. In addition, shims of varying thickness may be provided to effect adjustment of the bearing clearance between the various parts.

Lock pin cylinders 238 and 238' are secured to each of the cradles 202 and 202', respectively. The lock pin cylinders 238 and 238' are bidirectionally operative actuators (for example, electromagentic, penumatic, or hydraulic actuators) that include a cylinder **238*a* and a ram 238*b*. The lock pin cylinders 238 and 238' are mounted in registration with their respective lock pin holes 206 and 206' on the cradles 202 and 202' and can be selectively actuated as described below, to permit their rams 238*a* and/or 238*a'* to pass through the lock pin holes 234 and/or 234' on the remote ends of the outer and inner beams 230 and 230'**, respectively.

A main push/pull fluid actuator 240 (e.g. hydraulic) is provided to extend and retract the outer and inner beams 230 and 230' as described more fully below. The main actuator 240 includes a cylinder **240*a* and a ram 240*b* that is connected to an internally located piston 240*c* and fluid couplings 240*d* and 240*e* for introducing and/or removing hydraulic fluid under pressure into the cylinder 240*a* to effect operation. The actuator 240 includes an apertured lug 242 that is connected to the apertured tabs 236' of the outer beam 230' with a pin 244'. In a similar manner, the ram 240*b* includes a clevis 246 that connects to the aperture tab 236 of the outer beam 230 through a pin 244**.

Figures 7, 8, 9:
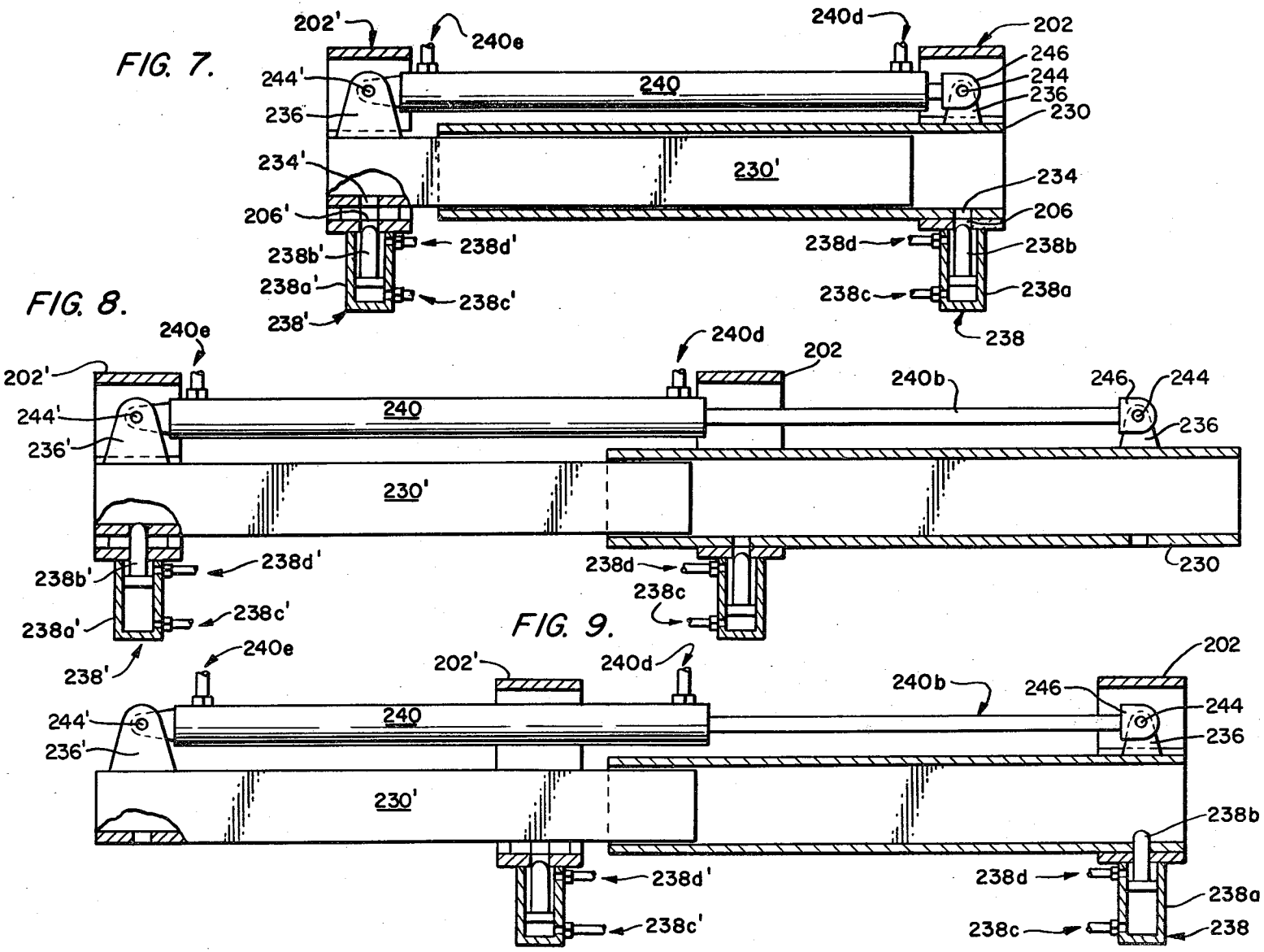
FIG. 7 is a plan view, in partial cross section, of the cross tie exchange apparatus shown in FIGS. 1 and 4 with the inner and outer telescoped beams shown in a fully retracted position with the tie clamping assemblies of FIG. 5 omitted for reasons of clarity.
FIG. 8 is a plan view, in partial cross section and similar to that shown in FIG. 7, showing the inner beam locked to its support cradle and the outer beam extended to the right.
FIG. 9 is a plan view, in partial cross section and similar to that shown in FIG. 7 and FIG. 8, showing the outer beam locked to its support cradle and the inner beam extended to the left.

An understanding of the manner by which the cross tie exchanger 20 operates to extract railroad ties T may be had by a consideration of FIGS. 7–9 in which the cradles 202 and 202' and the outer beam 230 have been shown in cross section, and in which the support tube 204, the clamping assemblies 100 and 100', and other parts have been omitted for reasons of clarity. In FIG. 7, both the outer beam 230 and the inner beam 230' are shown in their fully retracted positions in which the lock pin holes 206 and 206' of the cradles 202 and 202' and the lock pin holes 234 and 234' of the outer and inner beams 230 and 230', respectively, are in registration. The position shown in FIG. 7 represents the nested or fully retracted position of the cross tie exchanger 20. It is from this nested position that the cross tie exchanger 20 can be used to clamp and extract ties T from either direction, that is, the left or the right in FIGS. 7–9.

In order for the outer beam 230 to extend to the right in FIG. 7, pressurized hydraulic fluid is introduced into the port **238*c'* of the lock pin cylinder 238' (the left-hand cylinder in FIG. 7) to cause the lock pin 238*b'* to advance through the registered lock pin holes 206' of the cradle 202' and the lock pin hole 234' of the inner beam 230' to thereby secure the inner beam 230' to its support cradle 202'. Thereafter, pressurized hydraulic fluid is introduced into the port 240*e* of the main actuator 240 to cause it to extend. Since the inner beam 230' is secured by its lock pin 238*b'* to its cradle 202', the outer beam 230 will be forced to the right as shown in FIG. 8 with the degree of extension depending upon the amount of hydraulic fluid introduced into the main actuator 240. In order to retract the so-extended outer beam 230, pressurized hydraulic fluid is introduced into the port 240*d* of the main actuator 240 to cause the partially or fully extended outer beam 230** to retract to its fully retracted or nested position.

In order to extend the inner beam 230', pressurized hydraulic fluid is introduced into the port **238*c* of the lock pin cylinder 238' (the right-hand cylinder in FIG. 9) to cause the lock pin 238*b* to pass through the registered lock pin holes 206 of the cradle 202 and lock pin hole 234 of the outer beam 230 to thereby lock the outer beam to its support cradle. Thereafter, pressurized hydraulic fluid is introduced into the main actuator 240** through port 240*e* to cause the main actuator to expand. Since the outer beam 230 is locked to its support cradle 202, the inner beam 230' will extend outwardly toward the left as shown in FIG. 9. In order to cause the inner beam 230' to retract from its extended position, pressurized hydraulic fluid is introduced through port 240*d* to cause the main actuator 240 to retract along with the inner beam 230'.

Hydraulic circuitry for effecting functional control of the cross tie exchanger 20 is shown in FIGS. 10A–10E. In FIG. 10A, a three position, four way hydraulic valve 300 is connected between the main actuator 240, a source of pressurized hydraulic fluid P and a hydraulic fluid reservoir or sump S. The valve 300 is normally biased to an intermediate position as shown in FIG. 10A in which no hydraulic fluid is introduced into or removed from the actuator 240. Actuation of the valve 300 to the right causes the main actuator 240 to extend, and, conversely, actuation of the valve 300 to the left causes the main actuator to retract. Hydraulic circuitry for effecting control of the lock pin cylinders 238 and 238' is shown in FIGS. 10B and 10C. In FIG. 10B, a three position, four way hydraulic valve 302 is connected between the lock pin cylinder 238 and the aforementioned source of pressurized fluid P and the hydraulic reservoir S. Operation of the valve 302 to the right causes the lock pin to actuate and operation of the valve towards the left causes it to unlock. A resilient spring biasing means (not shown) may be provided to bias the valve 302 to the unlocked position. The lock pin cylinder 238' shown in FIG. 10C is similarly operated through its associated valve 302'. As shown in FIGS. 10D and 10E, the cross tie exchanger 20 elevation control cylinders 24 and 24' are also controlled through three position, four way hydraulic valves 304 and 304' in a manner similar to the valving previously described. Hydraulic circuitry for operating the cylinders 124 and 124' of the clamping assembly 100 and 100', while not specifically shown, is essentially the same as shown in FIGS. 10B–10E as explained above.

In order to remove a cross tie T from a road bed, the railway vehicle 22 upon which the cross tie exchanger 20 is mounted is moved along the track 28 until the cross tie exchanger 20 is positioned over the tie T to be exchanged. Thereafter, the elevation control cylinders 24 and 24' on either side of the rail vehicle 22 are operated through appropriate manipulation of the bidirectional valves 304 and 304' (FIGS. 10D and 10E) so that the cross tie exchanger 20 is positioned directly over the tie T to be exchanged and has an alignment attitude approximately parallel to the tie T. By providing independently controllable elevation cylinders 24 and 24', it is possible to closely match the angle of inclination of the cross tie exchanger 20 with that of the tie T to be removed. This feature is particularly useful when ties from deteriorated rail beds are to be removed where the ties have angularly shifted from their as-installed positions. Thereafter, the appropriate lock pin cylinder 238 or 238' is actuated to lock the beam that is not to be extended 230 or 230' to its respective cradle 202 or 202'. After the beam locking is completed, the appropriate clamping assembly 100 or 100' is operated through actuation of the respective cylinder 124 or 124' to cause the clamping arms 102*a* and 102*b* or 102*a'* and 102*b'* to grip the end of the tie T in the rail bed. Once the tie to be replaced is gripped, the main actuator 240 is operated through appropriate manipulation of the valve 300 to cause the unlocked beam to extend laterally outward from the road bed carrying the tie T with it. In the preferred embodiment, the inner and outer beams are each approximately 7' long and are effective for removing a tie T in a single stroke. However, as can be appreciated by those skilled in the art, a railway cross tie may be "walked" out of its position in the road bed by clamping the end of the tie, partially extending the respective beam, releasing the clamp on the tie, retracting the partially extended beam, regripping the tie adjacent the rail bed, and then further extending the beam to incremently remove the tie from the road bed. Once the tie has been removed, a new tie may be gripped on end and inserted into the position left by the removed tie. The new tie can be inserted from the same side that the old tie was removed or, if preferred, from the opposite side, taking advantage of the bidirectionally operative nature of the cross tie exchanger 20.

As is known in the art, a hoisting or lifting apparatus (not shown) may be provided for connection to the rails 28 to relieve the loading on the tie to be removed to facilitate the operation of the cross tie exchanger.

Figures 11, 12:
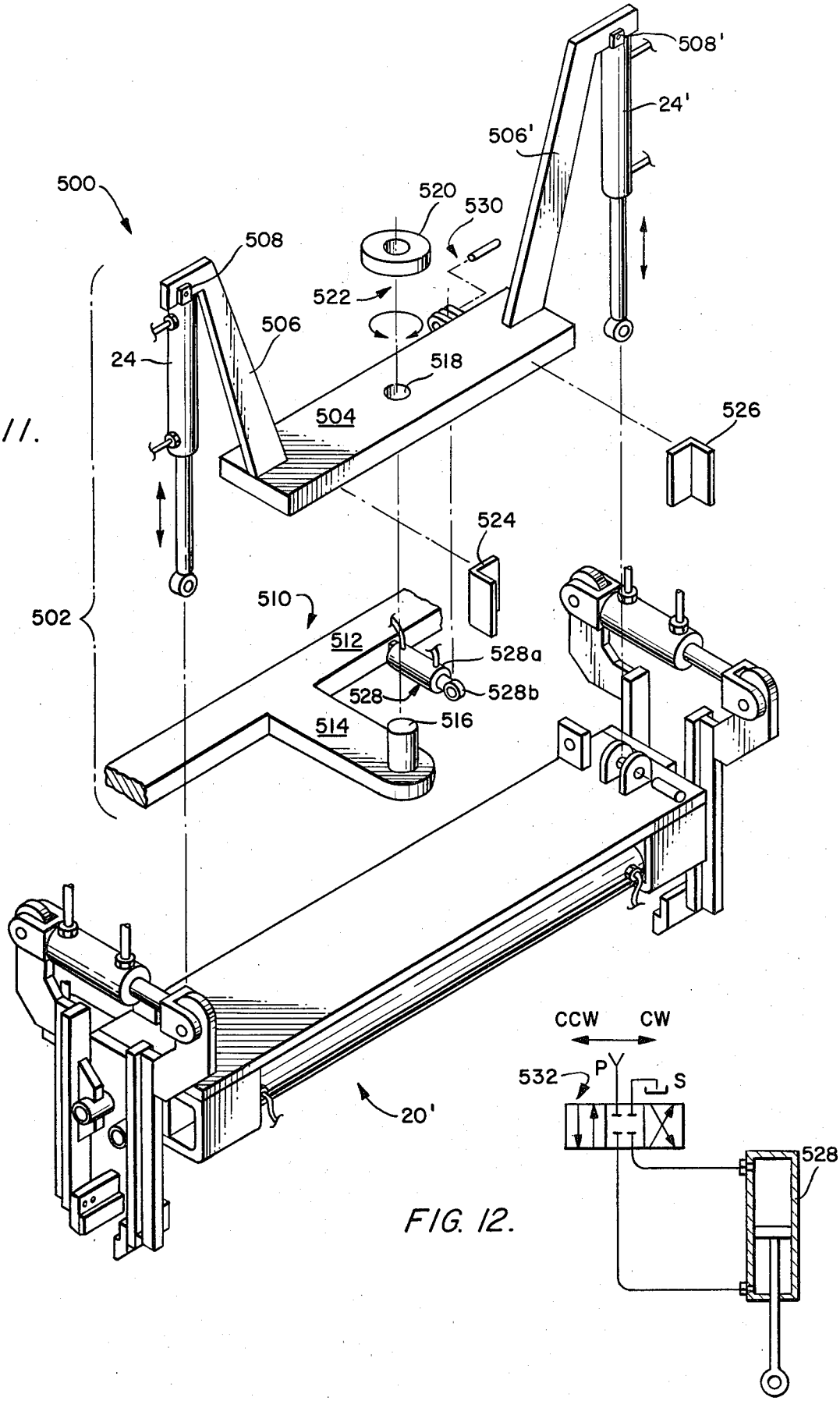
FIG. 11 illustrates a further embodiment of the present invention in which the beam assembly is mounted to a turret assembly to permit selective bidirectional rotation about the vertical axis.
FIG. 12 illustrates a hydraulic circuit for controlling the degree of rotation of the beam assembly of the turretted embodiment of FIG. 11.

A second embodiment of the present invention that incorporates a turreted support to provide relative rotation about the vertical axis is shown in FIG. 11 and is referred to therein generally by the reference character 500. The tie exchanger 500 includes a turret assembly 502 to which a modified tie exchanger 20' is attached. The turret assembly 502 includes a turret support plate 504 that includes upwardly extending and outwardly inclined crane arms 506 and 506' at the opposite ends thereof. The upper distal ends of the crane arms 506 and 506' are apertured for connection by conventional clevis and pin connectors 508 and 508' to the upper ends of the elevation control cylinders 24 and 24' described above. A turret support member 510 includes a structural support mean 512 that extends laterally across the width of the rail vehicle and is secured to the vehicle frame (not shown). A turret support extension 514 is connected, as by welding, to the laterally extending structural support beam 512 at a point intermediate its ends. An upwardly extending pintle 516 is secured to the turret support extension 514. The turret support plate 504 includes a centrally located bore 518 through which the pintle 516 extends to permit relative rotation therebetween. A turret cap 520 is secured to the upper end of the pintle 516 to prevent unintentional disengagement of the turret support plate 504 from the pintle 506. The organization of the turret structure permits the turret assembly 502 and its connected tie exchanger 20' to rotate either clockwise or counter clockwise about the vertical axis 522 and to a selected maximum value (e.g. plus or minus 20°). The beam assembly 200' differs from that described above in that the guide plate 212 and the guide rails 214 and 214' (FIG. 4) are not utilized. Instead, a guide surface set 524 and 526 (only one guide from each set being shown) is secured to the turret support plate 504 to constrain the beam assembly 200' from movement in the fore and aft direction. Additional constraining members (not shown) are provided to limit side-to-side movement of the beam assembly 200' relative to the turret support plate 504. A hydraulic actuator 528 is provided to control rotation of the turret assembly 502 about the pintle 516 and includes a cylinder portion 528*a* connected to the lateral support beam 512 and a ram 528*b* connected to the turret support plate 504 via a clevis and pin connectin 530. A hydraulic circuit for operating the hydraulic actuator is shown in FIG. 12 and includes a three position, four way hydraulic valve 532 connected between the rotation control cylinder 528 and the aforementioned source of pressurized fluid P and the hydraulic reservoir S. Operation of the valve 532 to the right causes the rotation actuator 528 to extend and rotate the turret assembly 502 clockwise about the vertical axis 522. Conversely, operation of the valve 532 to the left causes the rotation cylinder 528 to retract and cause the turret assembly 502 to rotate counter clockwise about the vertical axis 522. As can be appreciated, selected control of the valve 532 permits the turret assembly to be rotated about the vertical axis 522 so as to provide precise alignment between the beam assembly 200' and the tie to be removed. This feature is particularly valuable when removing cross ties from the turn out portion of a switch where the ties may lie at an angle relative to the direction of the rails.

In order to remove a cross tie from a road bed using the cross tie exchanger 500 shown in FIG. 12, the railway vehicle 22 upon which the cross tie exchanger 500 is mounted is moved along the track 28 until the cross tie exchanger 500 is positioned over the tie T to be exchanged. Thereafter, the turret rotation control cylinder 528 is operated so that the beam assembly 200' is aligned precisely with the alignment of the tie to be exchanged. Thereafter, the elevation control cylinders 24 and 24' on either side of the rail vehicle 22 are operated through appropriate manipulation of the bidirectional valves 304 and 304' (FIGS. 10D and 10E) so that the cross tie exchanger 20' is positioned directly over the tie to be exchanged and has an alignment or attitude approximately parallel to the tie to be exchanged. Thereafter, the appropriate lock pin cylinder 238 or 238' is actuated to lock the beam that is not to be extended 230 or 230' to its respective cradle 202 or 202'. The appropriate clamping assembly 100 or 110' is then operated through actuation of the respective cylinder 124 or 124 to cause the clamping arms **102*a* and 102*b* or 102*a'* and 102*b'* to grip the end of the tie in the rail bed. Once the tie to be exchanged is gripped, the main actuator 240** is operated as described above to effect removal of the tie.

As can be appreciated from the above, the cross tie exchanger 20 is well suited for removing and replacing railway cross ties T from one side of the road bed or the other. The independent elevation control cylinders and the turret design provide substantial operational freedom for removing ties that are not optimally positioned for removal. This latter feature is a distinct advantage when removing and replacing rail ties at switches, frogs, or the like.

In the disclosed embodiment, the various actuators have been shown as hydraulic cylinders. Other types of actuators, including electrical, pneumatic, and even manual are suitable. Likewise, while the cross tie exchanger is shown with outer and inner beams having a square or rectangular cross section, beams having other cross sections are equally suitable.

As can be appreciated by those skilled in the art, various changes and modifications may be made to the disclosed embodiments of the cross tie exchanger without departing from the spirit and scope of the invention as defined in the appended claims and their legal equivalent.

What is claimed is:

1. A railway tie removing apparatus comprising:

an extensible beam means including first and second beams, one telescopically received within the other;

an adjustable support means for supporting said beam means relative to a support vehicle, said support means selectively adjustable to position said beam means relative to the axis of the tie to be removed;

selectively actuatable lock means for locking a selected one of said first and second beams to said support means;

tie gripping means mounted on said first and said second beams for selectively gripping a railway cross tie; and force actuator means connected to said first and to said second beams for causing said first and said second beams to telescopically extend relative one another;

whereby actuating said locking means to lock one of the first and second beams to the support means and unlock the other and operating the force actuator means causes the unlocked other of the first and second beams to extend relative to the locked beam, and actuating said locking means to lock the other of the first and second beams to the support means and unlock the one and operating the force actuator means causes the unlocked one of the first and second beams to extend relative to the locked other beam.

2. A railway cross tie exchanging apparatus comprising:

reversibly extensible beam means including first and second beams, one telescopically received within the other;

an adjustable support means for supporting said beam means relative to a support vehicle, said support means selectively adjustable to position said beam means relative to the axis of the tie to be removed;

selectively actuatable lock means for selectively locking one of said first and second beams to said support means to prevent relative movement;

tie gripping means mounted on said first and said second beams for selectively gripping a railway cross tie;

reversible force actuator means connected between said first and second beams to cause said first and second beams to telescopically extend and retract relative one another;

whereby actuating the locking means to lock the first beam to the support means and unlock the second beam and operating the force actuator means to extend causes the unlocked second beam to extend relative to the locked first beam, and causing the force actuator means to retract causes the so-extended unlocked second beam to retract relative to the locked first beam, and whereby actuating the locking means to lock the second beam to the support means and operating the force actuator means to extend causes the first beam to extend relative to the locked second beam and causing the force actuator means to retract causes the first so-extended beam to retract relative to the locked second beam.

3. The apparatus claimed in claims 1 or 2 wherein said first and second beams have a rectangular cross section, one of said beams hollow so as to telescopically receive the other therein.

4. The apparatus claimed in claims 1 or 2 wherein said adjustable support means supports said beam means substantially along the lateral axis of its support vehicle for extension in a direction laterally of said vehicle.

5. The apparatus claimed in claim 4 wherein said adjustable support means supports said beam means for movement in a generally vertical direction.

6. The apparatus claimed in claim 4 wherein said adjustable support means supports said beam means for selective positioning at an angle relative the horizontal.

7. The apparatus claimed in claim 4 wherein said adjustable support means supports said beam means for selective rotation about a generally vertical axis.

8. The apparatus claimed in claim 4 wherein said adjustable support means supports said beam for selective positioning at an angle relative to the horizontal, and for selective rotation about a generally vertical axis.

9. The apparatus claimed in claim 4 wherein said adjustable support means comprises:

turret mounted on the support vehicle and including a first stationary portion secured to said support vehicle and a second portion mounted on said first portion for relative rotation therebetween.

10. The apparatus claimed in claim 9 wherein said adjustable support means further comprises:

a rotation controlling fluid actuator connected between said first and second portions of said turret means to effect controlled rotary positioning therebetween.

11. The apparatus claimed in claim 4 wherein said adjustable turret means further comprises:

elevation controlling fluid actuator means connected between the second portion of said turret means and said supported beam means for moving said supported beam means in a generally vertical direction and for adjustably positioning the angle of the supported beam means relative to the tie to be removed.

12. The apparatus claimed in claims 1 or 2 wherein said selectively actuatable locking means further comprises:

first locking means associated with said first beam for selectively locking said first beam against movement relative to said support means; and second locking means associated with said second beam for selectively locking said second beam against movement relative to said support means.

13. The apparatus claimed in claim 12 wherein said first and second locking means further comprises:

a locking pin connected to a lock pin actuator for causing said locking pin to advance into a lock pin receiving opening in the respective beam to lock said beam to said support means and for causing said locking pin to be retracted from said lock pin receiving opening to thereby unlock said beam.

14. The apparatus claimed in claims 1 or 2 wherein said tie gripping means comprises:

first tie gripping means connected to said first beam and second tie gripping means connected to said second beam, said first and second tie gripping means including pivotably mounted arms for releasably gripping a tie therebetween.

15. The apparatus claimed in claim 14 wherein said first and second pivotable arms are connected at their upper end by a push/pull force actuator and include tie clamping pads at their lower end for gripping a tie therebetween.

16. The apparatus claimed in claims 1 or 2 wherein said force actuator means comprises:

fluid cylinder means having a cylinder portion connected to one of said first and second beams and a ram portion connected to the other of said first and second beams, said fluid cylinder means reversibly actuatable to cause extension and retraction of said beams relative to one another.

17. The apparatus claimed in claim 16 wherein said fluid cylinder means is a push/pull hydraulic cylinder.

18. A railway tie exchanging apparatus comprising:

first and second beams, one telescopically received within the other;

first tie clamping means connected to an end of said first beam and second tie clamping means connected to an end of said second beam, said first and second tie clamping means selectively actuatable to grip a railway cross tie;

support means for supporting said first and second beams in a substantially horizontal attitude aligned substantially along a lateral axis of the support vehicle, for movement in a generally vertical direction;

first selectively actuatable locking means for locking said first beam against movement relative to said support means;

second selectively actuatable locking means for locking said second beam against movement relative to said support means; and fluid actuator means connected between said first and second beams, said fluid actuator means operable to cause said first and second beams to extend relative to one another and operable to cause said first and second beams to retract relative one another;

whereby actuation of the first locking means to lock the first beam against movement relative to the support means and operating the first fluid actuator means to extend causes the second beam to extend releative to the first beam and operating the fluid actuator means to retract causes the so-extended second beam to retract relative to the first beam, and actuation of the second locking means to lock the second beam against movement relative to the support means and operating the fluid actuator means to extend causes the first beam to extend relative to the second beam and operating fluid actuator means to retract causes the so-extended first beam to retract relative to the second beam.

19. The apparatus claimed in claim 18 wherein said support means supports said beams for selective positioning at an angle relative to the horizontal.

20. The apparatus claimed in claim 18 wherein said support means supports said beams for selective rotation about a generally vertical axis.

21. The apparatus claimed in claim 18 wherein said support means supports said beams for selective positioning at an angle relative to the horizontal, and for selective rotation about a generally vertical axis.

* * * * *